United States Patent [19]

Prodan

[11] Patent Number: 5,056,618

[45] Date of Patent: Oct. 15, 1991

[54] LOUDSPEAKER HOUSING

[76] Inventor: Hans-Joachim Prodan, Birkenallee 7, D-4415 Albersloh, Fed. Rep. of Germany

[21] Appl. No.: 468,688

[22] Filed: Jan. 19, 1990

[30] Foreign Application Priority Data

Feb. 2, 1989 [DE] Fed. Rep. of Germany ..... 3903085
Feb. 23, 1989 [DE] Fed. Rep. of Germany ..... 3905562

[51] Int. Cl.[5] ..... A47B 81/06
[52] U.S. Cl. ..... 181/199
[58] Field of Search ..... 181/146, 151, 294, 198, 181/199; 524/439, 440, 441

[56] References Cited

U.S. PATENT DOCUMENTS 4,802,551 2/1989 Jacobsen ..... 181/146
4,869,346 9/1989 Coudoux ..... 181/146

FOREIGN PATENT DOCUMENTS 0005473 4/1979 European Pat. Off. .
78762 9/1969 Fed. Rep. of Germany .
2714016 11/1977 Fed. Rep. of Germany .
2427897 1/1978 Fed. Rep. of Germany .
2821001 11/1979 Fed. Rep. of Germany .
3630132 3/1988 Fed. Rep. of Germany .
0139593 8/1983 Japan ..... 181/198

*Primary Examiner*—Brian W. Brown
*Attorney, Agent, or Firm*—Peter K. Kontler

[57] ABSTRACT

A loudspeaker housing which is a one-piece casting or is assembled of two or more separately cast sections is obtained by pouring into one or more mold cavities a mixture of three components, namely a hard first component (e.g., particles of sand with a grain size of 0.1 to 3 mm) having a high specific weight, a second component which has a viscosity of between 150 and 10,000 mPa.s (such as a twin-component adhesive or a grouting compound), and a relatively soft but heavy third component (such as granulated rubber tires and/or polyvinyl chloride and/or polyethylene). The sound damping characteristics of the thus obtained loudspeaker housing are superior to those of housings which are made of wood, plastic or ceramic material.

8 Claims, 1 Drawing Sheet

LOUDSPEAKER HOUSING

BACKGROUND OF THE INVENTION

The invention relates to housings or cabinets for loudspeakers, and to a method of making loudspeaker housing. More particularly, the invention relates to a method of making a loudspeaker housing and to a loudspeaker housing which is a one-piece or composite casting.

At the present time, housings for electroacoustic transducers (hereinafter called loudspeakers) are made of wood, a plastic material or a ceramic material. The nonlinear distortion factor (also known as relative harmonic content, k-factor or klirrfactor) of wood and plastic material is relatively low, and the damping characteristics of these materials are rather satisfactory when the demands upon the quality of amplified sound are not very high. If the loudspeaker housing is to be used as part of a high-quality sound generating and amplifying equipment, especially as concerns its internal damping characteristics, wood and/or a plastic material cannot meet the requirements and, therefore, the housings of loudspeakers forming part of a high-quality sound generating and amplifying system are often made from a ceramic material. However, it has been found that loudspeakers having housings made of a ceramic material also fail to meet the requirements which are imposed upon high-quality sound generating and amplifying equipment.

In summation, heretofore used materials for the making of loudspeaker housings or cabinets exhibit unsatisfactory damping characteristics (such characteristics are typical of loudspeaker housings which are made of particle board), or the materials are satisfactory acoustic conductors but exhibit a selective sound transmissivity (examples of materials for such loudspeaker housings are concrete, marble and natural stone). In addition, all of the presently utilized materials for the making of loudspeaker housings exhibit the drawback that they "live their own musical life" which is evidently undesirable for a number of reasons.

OBJECTS OF THE INVENTION

An object of the invention is to provide a loudspeaker housing or cabinet which does not exhibit any or any appreciable natural or self-resonance.

Another object of the invention is to provide a loudspeaker housing which does not emit or transmit the sound energy which is generated in or supplied to its interior.

A further object of the invention is to provide a novel and improved starting material for the making of loudspeaker housings.

An additional object of the invention is to provide a novel and improved method of making loudspeaker housings.

Still another object of the invention is to provide a simple and inexpensive loudspeaker housing which can be furnished in any desired size and/or shape and which can be used as a support for sound amplifying means in high-quality sound generating and amplifying systems.

SUMMARY OF THE INVENTION

One feature of the present invention resides in the provision of a loudspeaker housing or cabinet which is composed of or comprises a cast mixture of a first component consisting of particles of sand with a grain size of 0.1 to 3 mm and/or pure metallic powder and/or titanium carbide and/or granulated ilmenite (titaniferous iron ore) and/or pulverulent chromite (chromic iron ore) and/or lead monosilicate frit powder and/or pulverulent flint glass and/or plutonic rock powder and/or ceramic powder; a second component having a viscosity between 150 and 10,000 mPa.s and consisting of a twin-component adhesive and/or a grouting compound; and a third component consisting of granulated rubber with a grain size of 0.01 to 1 mm and/or soft polyvinyl chloride and/or polyethylene. The weight ratio of the second component in the mixture is greater than the ratio of the third component but less than the ratio of the first component.

If the third component of the mixture contains or consists of granulated rubber, this ingredient can be obtained by comminuting rubber tires, particularly used rubber tires.

If the first component of the mixture contains or consists of particles of sand, such particles are preferably round or (irregularly) round in part.

The improved housing or cabinet can consist of a single cast section having a front wall, a rear wall, at least two sidewalls between the front and rear walls, a top wall and a bottom wall. Alternatively, the housing can comprise a plurality of discrete cast sections including a front wall, a rear wall, at least two sidewalls extending between the front and rear walls, a top wall and a bottom wall.

It is also possible to assemble the housing of at least two cast sections including a first section consisting of a front wall and sidewalls, and a second section constituting a rear wall which is bonded to the first section.

Another feature of the invention resides in the provision of a method of making a loudspeaker housing or cabinet which is a casting. The method comprises the steps of making a mixture of a comminuted hard and heavy first component, a bonding component having a viscosity of 150 to 10,000 mPa.s, and a comminuted heavy and soft third component; introducing the mixture into at least one mold cavity; and causing the mixture in the at least one mold cavity to set. The first component of the mixture preferably consists of particles of sand with a grain size of 0.1 to 3 mm and/or pure metallic powder and/or titanium carbide and/or granulated ilmenite and/or pulverulent chromite and/or lead monosilicate frit powder and/or pulverulent flint glass and/or plutonic rock powder and/or ceramic powder. The second component of the mixture can consist of twin-component or twin-compound adhesive and/or a casting compound. The third component of the mixture can consist of granulated rubber with a grain size of 0.01 to 1 mm and/or soft polyvinyl chloride and/or polyethylene. The weight ratio of the second component in the mixture is greater than the ratio of the third component but less than the ratio of the first component.

If the first component consists of or contains particles of sand, such particles are preferably washed and dried prior to admixture to the second and third components.

The novel features which are considered as characteristic of the invention are set forth in particular in the appended claims. The improved loudspeaker housing or cabinet itself, however, both as to its construction and the method of making the same, together with additional features and advantages thereof, will be best understood upon perusal of the following detailed description of certain presently preferred specific embodiments with reference to the accompanying drawing.

DESCRIPTION OF PREFERRED EMBODIMENTS

Figure 1:
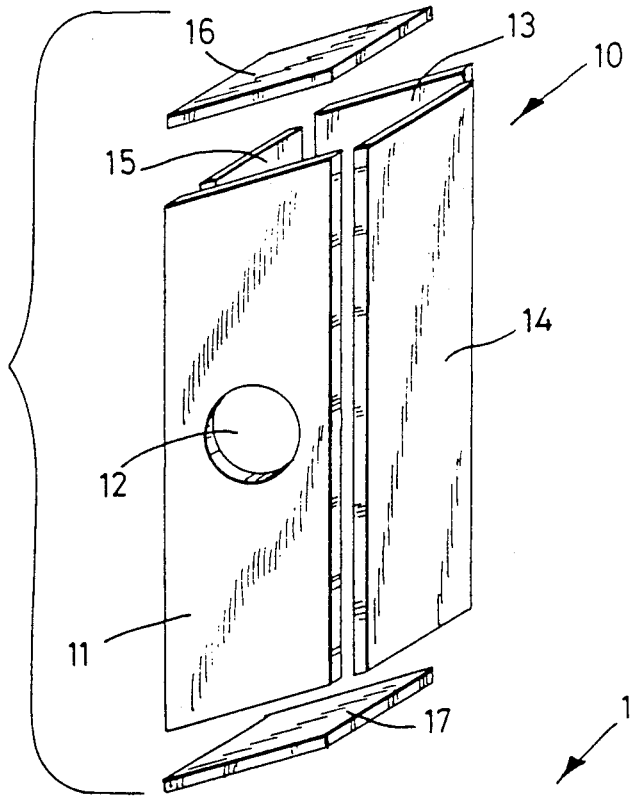
FIG. 1 is an exploded schematic perspective view of a composite loudspeaker housing which is assembled of six separately cast sections.

FIG. 1 shows a loudspeaker housing or cabinet 10 having a front wall 11 with an opening 12, a rear wall 13, a first sidewall 14, a second sidewall 15, a top wall 16 and a bottom wall 17. Each of the walls 11 and 13 to 17 is a separate casting which is produced in a discrete mold. Of course, if the sidewall 14 is identical with the sidewall 15, these sidewalls can be made in one and the same mold. The same holds true for the top wall 16 and the bottom wall 17. The separately cast walls 11 and 13 to 17 can be secured to each other by resorting to a suitable adhesive and/or to mechanical fastener means and/or in any other suitable way.

In accordance with a feature of the invention, the material which is poured into the cavities of molds for the making of walls 11 and 13 to 17 is a mixture of three components, namely a first component which consists of one or more heavy and hard materials, a second or bonding component having a viscosity of between 150 and 10,000 mPa.s, and a heavy but soft third component. The first component can consist of particles of sand with a grain size of 0.1 to 3 mm and/or pure metallic powder and/or pulverulent or granular titanium carbide and/or granulated ilmenite and/or pulverulent chromite and/or lead monosilicant frit powder and/or pulverulent flint glass and/or plutonic rock powder and/or ceramic powder. The second component can consist of a twin- or dual-component adhesive and/or a grouting compound. The third component can consist of granulated rubber with a grain size of 0.01 to 1 mm and/or soft polyvinyl chloride and/or polyethylene.

The percentage of the second component by weight preferably exceeds the percentage of the third component but is less than that of the first component.

If the third component consists of or contains granulated rubber, this material can be obtained by comminuting rubber tires, such as used or discarded rubber tires.

If the first component consists of or contains particles of sand, such particles are preferably washed and dried prior to admixture to the second and third components.

Figure 2:
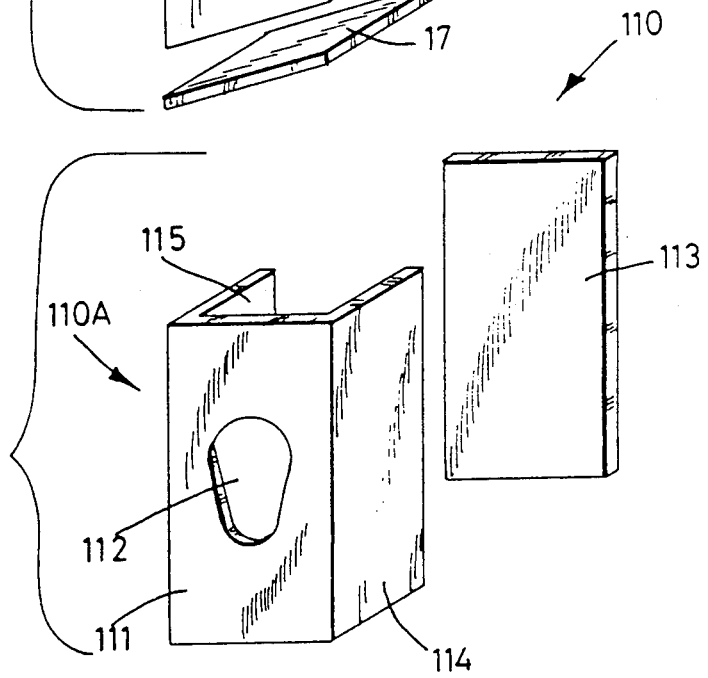
FIG. 2 is an exploded schematic perspective view of a portion of a second loudspeaker housing wherein the front wall and two sidewalls form a first cast section and the rear wall forms a separately cast second section.

Instead of assembling a loudspeaker housing from as many as six discrete separately cast sections or walls, it is equally within the purview of the invention to assemble the loudspeaker housing from fewer separately cast sections FIG. 2 shows a portion of a loudspeaker housing 110 having a first section 110A including a front wall 111 with an opening 112, a first sidewall 114 and a second sidewall 115. A second section 113 of the loudspeaker housing 110 includes or constitutes a rear wall. The top and bottom walls (not shown in FIG. 2) can constitute separately produced castings, they may be integral parts of the section 110A, they may be integral with the rear wall 113, or one thereof can be integral with the section 110A while the other is integral with the section or wall 113.

Figure 3:
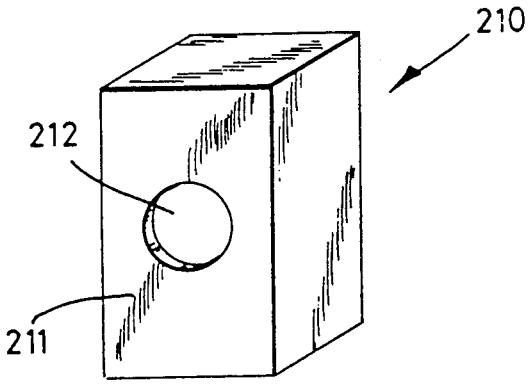
FIG. 3 is a schematic perspective view of a third loudspeaker housing which is a one-piece casting.

FIG. 3 shows a third loudspeaker housing 210 which is a one-piece casting wherein the front wall 211 has an opening 212.

The exact nature of the mold or molds which are used to make the improved loudspeaker housing or cabinet forms no part of the invention. The same applies for the steps of mixing the components of the material which is to be poured into the cavity or cavities, of admitting the mixture into the cavity or cavities and of causing or permitting the admitted material to set. As mentioned above, if a loudspeaker housing is to be assembled of two or more separately cast sections, the sections can be secured to each other by a bonding agent (such as a suitable adhesive), by mechanical fasteners and/or in any other suitable way.

It is already known to make cast articles by resorting to a mixture which consists of particles of sand, twin-component adhesive and granular rubber. Reference may be had, for example, to European Pat. No. 0 005 473 A1, to German Offenlegungsschriften Nos. 28 21 001 A1, 24 27 897 A1, 27 14 016 A1 and 36 30.132 A1, and to East German Pat. No. 78 762. These publications disclose the making of elastic coating materials for use in connection with the making of sports arenas. However, such and/or similar materials were not used for the making of loudspeaker housings or cabinets.

An advantage of the improved loudspeaker housing is that its components exhibit contrasting moduli of elasticity. It has been discovered by applicant that such materials (with contrasting or widely different moduli of elasticity) are capable of absorbing sound energy much more satisfactorily than the so-called monomodular substances. As already explained above, the first component of the mixture which is to be admitted into one or more mold cavities contains or consists of a hard material having a high specific weight, and the third component of the mixture contains a material which has a high specific weight but is much softer than the material of the first component. Combinations of materials exhibiting such in part contrasting characteristics are not readily available in the nature. Another desirable and advantageous characteristic of the material of the improved loudspeaker housing is that its thermal conductivity is better than average.

Experiments indicate that the characteristics of the improved loudspeaker housing or cabinet are particularly satisfactory if the first component of the mixture contains particles of sand which are round or have irregular shape with rounded portions, if the particle size of sand is between 0.1 and 3 mm and if the particles of sand are washed and dried prior to mixing them with the other two components. The second component consisted of a twin-component grouting compound on the epoxy or polyurethane basis, and the viscosity of the second component was between 150 and 10,000 mPa.s. The third component contained recycled rubber tires, i.e., discarded or used rubber tires which were comminuted to a particle size of 0.01 to 1 mm. Conversion of used rubber tires into granulates is customary for recycling of rubber in vulcanizing plants. The mixing ratio was as follows: between 200 and 300 parts by weight of sand particles, between 120 and 250 parts by weight of second component, and between 20 and 100 parts by weight of comminuted rubber.

Other hard and heavy materials, such as ilmenite, lead monosilicate frit powder, chromite, pulverulent ceramics and/or pulverulent flint glass, were admitted for the purposes of weight control. Such materials and/or other aforementioned constituents of the first component can replace a portion of or the entire quantity of sand particles. In this manner, the maker of the loudspeaker housing can select and optimize its sound damping characteristics. Additional regulation of sound damping characteristics can be achieved by appropriate selection of the hardness of the second component (grouting compound and/or a twin-component adhesive).

The second component can comprise a twin-component adhesive on the epoxy or polyurethane basis, e.g., an, adhesive known under the trade name "Metallon E 2642/Häter E2202" distributed by Henkel, Federal Republic Germany. Other materials which can be used as second components are known as WEPOX and WEPURAN, opaque grouting compounds known as VU 4000, VU 4400, VU 4410 and VU 4430, and VT 3407 distributed by Lackwerke Peters, Federal Republic Germany.

It has been found that the stability of the improved loudspeaker housing is satisfactory without the need for reinforcing, stiffening and/or armoring means. However, it is equally within the purview of the invention to employ reinforcing elements for the section or sections of the improved housing.

It is further clear that the size and/or the shape of the improved loudspeaker housing can be selected practically at will, i.e., the housings which are shown in FIGS. 1 to 3 are merely examples of housings or cabinets which can be produced in accordance with the method of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of my contribution to the art and, therefore, such adaptations should and are intended to be comprehended within the meaning and range of equivalence of the appended claims.

I claim:

1. A housing for sound amplifying means comprising a plurality of walls together constituting at least one section which is a cast mixture of a first component consisting of particles of sand with a grain size of 0.1 to 3 mm and/or pure metallic powder and/or titanium carbide and/or granulated ilmenite and/or pulverulent chromite and/or lead monosilicate frit powder and/or pulverulent flint glass and/or plutonic rock powder and/or ceramic powder; a second component consisting of a twin-component adhesive and/or a grouting compound and having a viscosity between 150 and 10,000 mPa.s; and a third component consisting of granulated rubber with a grain size of 0.01 to 1 mm and/or soft polyvinyl chloride and/or polyethylene.

2. The housing of claim 1, comprising of a first percentage by weight of said first component, a second percentage by weight of said second component, and a third percentage by weight of said third component, said second percentage being higher than said third percentage but less than said first percentage.

3. The housing of claim 1, wherein said granulated rubber consists of comminuted rubber tires.

4. The housing of claim 3, wherein said granulated rubber consists of comminuted used rubber tires.

5. The housing of claim 1, wherein said particles of sand are at least partially round.

6. The housing of claim 1, wherein said walls include a front wall, a rear wall, sidewalls extending between the front and rear walls, a top wall and a bottom wall, each of said walls constituting a separately cast section.

7. The housing of claim 1, wherein said walls include a front wall, a rear wall, sidewalls extending between the front and rear walls, a top wall and a bottom wall, said walls jointly constituting a single cast section.

8. The housing of claim 1, wherein said walls include a front wall and sidewalls together constituting a first cast section, and a rear wall constituting a second cast section, and further comprising means for bonding the second section to the first section.

* * * * *